US006467418B1

(12) United States Patent
Reina et al.

(10) Patent No.: US 6,467,418 B1
(45) Date of Patent: Oct. 22, 2002

(54) TANDEM SEWING MACHINE AND STITCH

(76) Inventors: Patrick W. Reina, 2617 Somerset Dr., Nashville, TN (US) 37217; Tatsuaki Kaneda, 5-7-2 Sagisu, Fukushima-Ku, Osaka (JP), 553-0002; Yoshikazu Kageyama, 5-7-2 Sagisu, Fukushima-Ku, Osaka (JP), 553-0002

( * ) Notice: Subject to any disclaimer, the term of this patent is extended or adjusted under 35 U.S.C. 154(b) by 13 days.

(21) Appl. No.: 09/638,747

(22) Filed: Aug. 14, 2000

(51) Int. Cl.[7] ..... D05B 1/08; D05B 27/08
(52) U.S. Cl. ..... 112/167; 112/312
(58) Field of Search ..... 112/163, 165, 112/167, 223

(56) References Cited

U.S. PATENT DOCUMENTS 190,475 A * 5/1877 Dawson ..... 112/167
1,276,950 A * 8/1918 Onderdonk ..... 112/226
1,309,272 A * 7/1919 Berger, Jr. ..... 112/226
4,241,677 A * 12/1980 Beisler ..... 112/167

* cited by examiner

*Primary Examiner*—Ismael Izaguirre

(57) ABSTRACT

A tandem sewing machine and the stitch it forms. The sewing machine includes a stand frame; a drive motor, a throatplate; and at least two offset needles. The offset needles have a needle stagger (σ) which, in combination with the needle spacing (D) produces a stitch stagger to displacement ratio (S/D) of greater than about 1 of the improved stitch. The sewing machine may also include an overedge stitching needle assembly and a compound feed assembly. In the preferred embodiment, the compound feed assembly includes a bottom feed dog and a top feed dog, wherein the top feed dog is a differential feed with respect to the bottom feed dog. The sewing machine may further include a second bottom feed dog which may also be a differential feed. In the preferred embodiment, the overedge stitching needle assembly includes at least one needle performing an overedge stitch.

24 Claims, 12 Drawing Sheets

Resultant Stitch
Prior Art
Single Needle Chuck

Staggered Offset Chuck (e.g., Risers)

Staggered Offset Chuck (e.g., Fell Seam)

Present Invention
Gauge
Displacement (D)
Stagger (σ)
See Fig 13

Stitch Length ≅ 40/32

S ≅ 1/8"
D ≅ 1/16"
⇒ S/D ≅ 2

S ≅ 1/2"
D ≅ 1/16"
⇒ S/D ≅ 8

S ≅ 20/32
D ≅ 1/16"
⇒ S/D ≅ 10

S > 1/2"
D ≅ 1/2"
⇒ S/D > 1

S ≅ 20/32
D ≅ 1/2"
⇒ S/D ≅ 1.25

$\Rightarrow S/D \cong 20$ $\Rightarrow S/D > 1$

TANDEM SEWING MACHINE AND STITCH

BACKGROUND OF THE INVENTION (1) Field of the Invention

The present invention relates generally to sewing machines and, more particularly, to a new and improved sewing machine for forming a faster, stronger stitch.

(2) Description of the Prior Art

The need for increasing the flow through or throughput speed, seam strength and overall general appearance for sewing operations is well established. Currently, the sewing industry uses parallel chain stitches to join two edges of apparel, such as workwear, which requires increased strength. Parallel chain stitches are typically found in such things as pant legs and shirt seams.

Although parallel chain stitches improve the strength of the edge, the flow through or throughput speed of fabric is no faster than that during the formation of conventional single chain stitch because the sewing machine usually forms the same number of stitches in order to have sufficient seam strength. Moreover, while seams of parallel chain stitches are stronger than seams of a single chain stitch, there is a need for even stronger seams that would hold up under even harsher conditions. Parallel chain stitches are formed primarily to have the redundancy of backing one another up but do not actually reinforce the strength of one another.

FIG. 1A shows a schematic of a needle represented by a dot of a single needle looking down on the flow through or throughput direction of the fabric and a reference line at about a 45 degree angle relative to the flow through or throughput direction of the fabric. The flow through or throughput direction of the fabric is designated by the arrow having its head pointing toward the top of the page. This single needle chuck arrangement produces a single chain stitch in a fabric as it is moved in the flow through or throughput direction past the single needle and the needle moves a thread in and out of the fabric.

FIG. 1B shows a schematic of two non-optional needles, each represented by a dot, and an optional needle, represent by the circled dot, of a staggered offset chuck for a flatbed-type machine looking down on the flow through or throughput direction of the fabric and a reference line at about a 45 degree angle relative to the flow through or throughput direction of the fabric. The two non-optional needles and the optional needle are aligned on the reference line. The flow through or throughput direction of fabric is designated by the arrow having its head pointing toward the top of the page. The optional needle is also the middle needle. This staggered offset chuck arrangement for a flatbedtype machine produces a parallel two chain stitch such as a riser or lap seam in fabric as it is moved in the flow through or throughput direction past each non-optional needle and the needles move separate threads in and out of the fabric. When the optional needle is included, this staggered offset chuck arrangement produces a parallel three chain stitch in fabric as it is moved in the flow through or throughput direction past each needle and the needles move separate threads in and out of the fabric. The needles are staggered or offset to create parallel chain stitches that are redundant and aligned to have substantially no stagger or offset.

FIG. 1C shows a schematic of two non-optional needles, each represented by a dot, and an optional needle, represent by the circled dot, of a staggered offset chuck for a feed-off-the-arm type machine looking down on the flow through or throughput direction of the fabric and a reference line at about a 45 degree angle relative to the flow through or throughput direction of the fabric. Only one of the non-optional needles is aligned on the reference line. The other non-optional needle and the optional needle are both off the reference line. The flow through or throughput direction of fabric is designated by the arrow having its head pointing toward the top of the page. The optional needle is also the middle needle. This staggered offset chuck arrangement for a feed-off-the-arm machine produces a parallel two chain stitch such as a fell seam or lap seam in fabric, as it is moved in the flow through or throughput direction past each non-optional needle and the needles move separate threads in and out of the fabric. When the optional needle is included, this staggered offset chuck arrangement produces a parallel three chain stitch in fabric as it is moved in the flow through or throughput direction past each needle and the needles move separate threads in and out of the fabric.

In both the flatbed-type machine and the feed-off-the-arm machine, the needles are staggered or offset to create parallel chain stitches that are redundant and aligned to have substantially no stagger or offset. The spacing of the parallel chains is dictated by the seam width and the interaction of damaged zones created within a fabric when a needle penetrated the fabric. That is, the non-optional needles must be spaced to create two parallel chain stitches that are spaced to capture the ends and end enveloping folds of the fabrics brought together by a seam, while preventing the creation of hanging or loose fabric that may catch or snag. Since the spacing of these redundant chains can be significant, each chain of the parallel two chain stitch may provide little reinforcement for the other. The non-optional needles and the optional needle must be spaced to create three parallel chain stitches that are spaced so that the damaged zones within the fabrics being brought together by the seam do not interact. Here too, each of these redundant chains of the parallel three chain stitch may provide little reinforcement for any of the other. Also as noted, since the parallel chain stitches are redundant and aligned to have substantially no stagger or offset, the flow through or throughput speed of fabric during their manufacture is no faster than that during the manufacture of a conventional single chain stitch, because the same number of stitches as a single chain stitch are formed to have sufficient seam strength. Thus, the flow through or throughput speed of fabric for the manufacture of single chain and parallel chains stitches is constrained by the mechanical limits of rotating and reciprocating parts of a machine.

Thus, there remains a need for a new and improved sewing machine and the stitch it forms, which uses a longer stitch to increase flow through or throughput speed of fabric and productivity, while at the same time, increases the pull strength of the sewn article.

SUMMARY OF THE INVENTION

The present invention is directed to a tandem sewing machine and the stitch it forms. The sewing machine includes a stand frame, a drive motor, a throatplate, and at least two offset needles. The offset needles have a needle stagger ($\sigma$) which, in combination with the needle spacing (D) produces a stitch stagger to displacement ratio (S/D) of greater than about 1 of the improved stitch. The resulting parallel stitching is characterized by a stitch offset or stitch stagger (S) and parallel or stitch spacing (D). It should be understood that the needle offset stagger ($\sigma$) is not necessarily the same as the stitch stagger (S). However, the needle spacing (D) is substantially equal to the parallel stitch spacing (D). The sewing machine may also includes an overedge stitching needle assembly and a compound feed assembly.

In the preferred embodiment, the compound feed assembly includes a bottom feed dog and a top feed dog, wherein the top feed dog is a differential feed with respect to the bottom feed dog. The sewing machine may further include a second bottom feed dog, which may also be a differential feed. In the preferred embodiment, the overedge stitching needle assembly includes at least one needle performing an overedge stitch.

It has been discovered that where the S/D ratio is greater than or equal to about 1, there is a substantial increase in pull strength which allows the stitch length to be greatly lengthened, thereby substantially increasing flow through or throughput speed of fabric and productivity. In the preferred embodiment, the S/D ratio is greater than about 1.3 and, preferably, about 20.

Accordingly, one aspect of the present invention is to provide a tandem sewing machine. The sewing machine includes a stand frame, a drive motor, a throatplate, and least two offset needles, wherein stitch formed by the offset needles has a stagger to displacement ratio (S/D) of greater than about 1.

Another aspect of the present invention is to provide a tandem sewing machine. The sewing machine includes a stand frame, a drive motor, a throatplate, and at least two offset needles, wherein the stitch formed by the offset needles has a stagger to displacement ratio (S/D) of greater than about 1, and an overedge stitching needle assembly.

Still another aspect of the present invention is to provide a tandem sewing machine. The sewing machine includes a stand frame; a drive motor; a throatplate; and at least two offset needles wherein stitch formed by the offset needles has a stagger to displacement ratio (S/D) of greater than about 1; an overedge stitching needle assembly; and a compound feed assembly.

The present invention is also directed to an improved stitch. The improved stitch is a parallel, offset chain stitch having a stagger to displacement ratio (S/D) of greater than about 1. It has been discovered that where the S/D ratio is greater than or equal to about 1, there is a substantial increase in pull strength, which allows the stitch length to be greatly lengthened. Also, it has been discovered that where the stitches are greatly lengthened, there is a substantial increase in fabric flow through or throughput speed, thereby substantially increasing productivity. In the preferred embodiment, the S/D ration is greater than about 1.3 and, preferably, about 20.

Accordingly, one aspect of the present invention is the stitch having a S/D ratio greater than or equal to about 1 and an overedge stitch.

These and other aspects of the present invention will become apparent to those skilled in the art after a reading of the following description of the preferred embodiment when considered with the drawings.

DESCRIPTION OF THE PREFERRED EMBODIMENTS

Figures 1A, 1B, 1C, 1D:
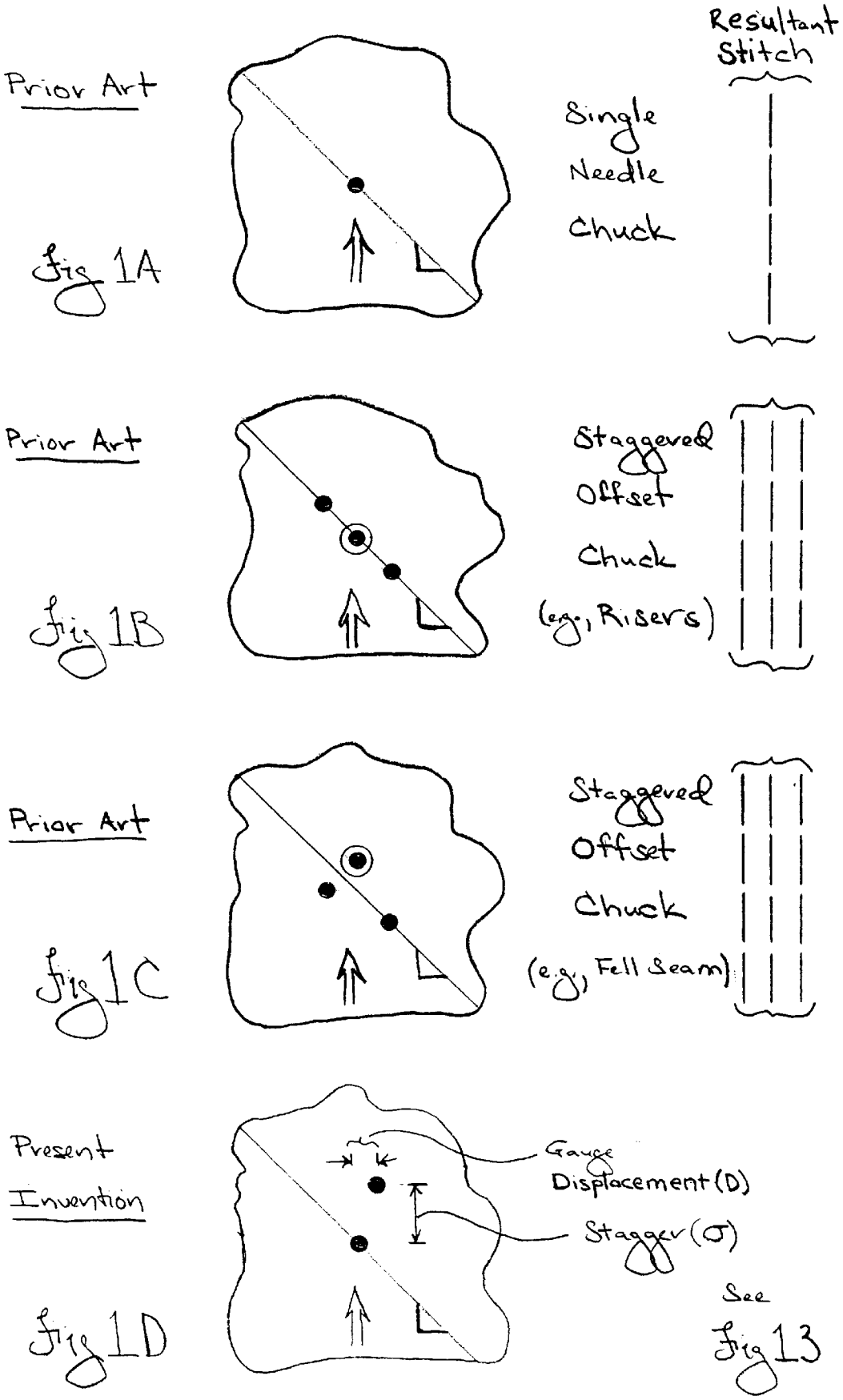
Fig 1A Prior Art
Fig 1B Prior Art
FIG. 1A is a schematic for a needle pattern of a single needle chuck of the prior art.
FIG. 1B is a needle pattern for a staggered offset chuck of a flatbed-type machine for making risers of the prior art.
FIG. 1C is a needle pattern for a staggered offset chuck of a feed-off-the-arm-type machine for making fell seams of the prior art.
FIG. 1D is a new needle pattern formed using a tandem needle sewing machine constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

FIG. 1A shows a schematic of a needle represented by a dot of a single needle looking down on the flow through or throughput direction of the fabric and a reference line at an about 45 degree angle relative to the flow through or throughput direction of the fabric. The flow through or throughput direction of the fabric is designated by the arrow having its head pointing toward the top of the page. This single needle chuck arrangement produces a single chain stitch in a fabric as it is moved in the flow through or throughput direction past the single needle and the needle moves a thread in and out of the fabric.

FIG. 1B shows a schematic of two non-optional needles, each represented by a dot, and an optional needle, represent by the circled dot, of a staggered offset chuck for a flatbed type machine looking down on the flow through or throughput direction of the fabric and a reference line at an about 45 degree angle relative to the flow through or throughput direction of the fabric. The two non-optional needles and the optional needle are aligned on the reference line. The flow through or throughput direction of fabric is designated by the arrow having its head pointing toward the top of the page. The optional needle is also the middle needle. This staggered offset chuck arrangement for a flatbed-type machine produces a parallel two chain stitch such as a riser or lap seam in fabric as it is moved in the flow through or throughput direction past each non-optional needle and the needles move separate threads in and out of the fabric. When the optional needle is included, this staggered offset chuck arrangement produces a parallel three chain stitch in fabric as it is moved in the flow through or throughput direction past each needle and the needles move separate threads in and out of the fabric. The needles are staggered or offset to create parallel chain stitches that are redundant and aligned to have substantially no stagger or offset.

FIG. 1C shows a schematic of two non-optional needles, each represented by a dot, and an optional needle, represent by the circled dot, of a staggered offset chuck for a feed-off-the-arm-type machine looking down on the flow through or throughput direction of the fabric and a reference line at an about 45 degree angle relative to the flow through or throughput direction of the fabric. Only one of the non-optional needles is aligned on the reference line. The other non-optional needle and the optional needle are both off the reference line. The flow through or throughput direction of fabric is designated by the arrow having its head pointing toward the top of the page. The optional needle is also the middle needle. This staggered offset chuck arrangement for a feed-off-the-arm machine produces a parallel two chain stitch such as a fell seam or lap seam in fabric as it is moved in the flow through or throughput direction past each non-optional needle and the needles move separate threads in and out of the fabric. When the optional needle is included, this staggered offset chuck arrangement produces a parallel three chain stitch in fabric as it is moved in the flow through or throughput direction past each needle and the needles move separate threads in and out of the fabric.

In both the flatbed type machine and the feed-off-the-arm machine, the needles are staggered or offset to create parallel chain stitches that are redundant and aligned to have substantially no stagger or offset. The spacing of the parallel chains is dictated by the seam width and the interaction of damaged zones created within a fabric when a needle penetrated the fabric. That is, the non-optional needles must be spaced to create two parallel chain stitches that that are spaced to capture the ends and end enveloping folds of the fabrics brought together by a seam while preventing the creation of hanging or loose fabric that may catch or snag. Since the spacing of these redundant chains can be significant, the each chain of the parallel two chain stitch may provide little reinforcement for the other. The non-optional needles and the optional needle must be spaced to create three parallel chain stitches that are space so that the damaged zones within the fabrics being brought together by the seam do not interact. Here too, the each of these redundant chains of the parallel three chain stitch may provide little reinforcement for any of the other. Also as note, since the parallel chain stitches are redundant and aligned to have substantially no stagger or offset, the flow through or throughput speed of fabric during their manufacture is no faster than that during the manufacture of a conventional single chain stitch because the same number of stitches as a single chain stitch are formed to have sufficient seam strength. Thus, the flow through or throughput speed of fabric for the manufacture of single chain and parallel chains stitches is constrained by the mechanical limits of rotating and reciprocating parts of a machine.

To the contrary, FIG. 1D shows a schematic of at least two offset needles, each represented by a dot, for a tandem machine looking down on the flow through or throughput direction of the fabric and a reference line at an about 45 degree angle relative to the flow through or throughput direction of the fabric. Only one of the two needles is aligned on the reference line. The other needle is offset ,i.e., staggered a distance ($\sigma$) and displaced a distance (D), from the needle on the reference line. The flow through or throughput direction of fabric is designated by the arrow having its head pointing toward the top of the page. An optional overedge stitch needle, not depicted, may be added to this schematic. These at least two offset needles produces a parallel, offset chain stitch having a stagger to displacement ratio (S/D) of greater than about 1 in fabric as it is moved in the flow through or throughput direction past each of the at least two needles and the needles move separate threads in and out of the fabric. When the optional needle is included, these at least two offset needles produce and the optional needle produce a parallel, offset chain stitch having a stagger to displacement ratio (S/D) of greater than about 1 and an overedge stitch in fabric and at it end as the fabric is moved in the flow through or throughput direction past each needle and the needles move separate threads in and out of the fabric. It has been discovered that where the S/D ratio is greater than or equal to about 1, there is a substantial increase in pull strength, which allows the stitch length to be greatly lengthened. Also, it has been discovered that where the stitches are greatly lengthened, there is a substantial increase in fabric flow through or throughput speed, thereby substantially increasing productivity. In the preferred embodiment, the S/D ratio is greater than about 1.3 and, preferably, about 20. It will be understood that the illustrations are for the purpose of describing a preferred embodiment of the invention and are not intended to limit the invention thereto.

Figure 2:
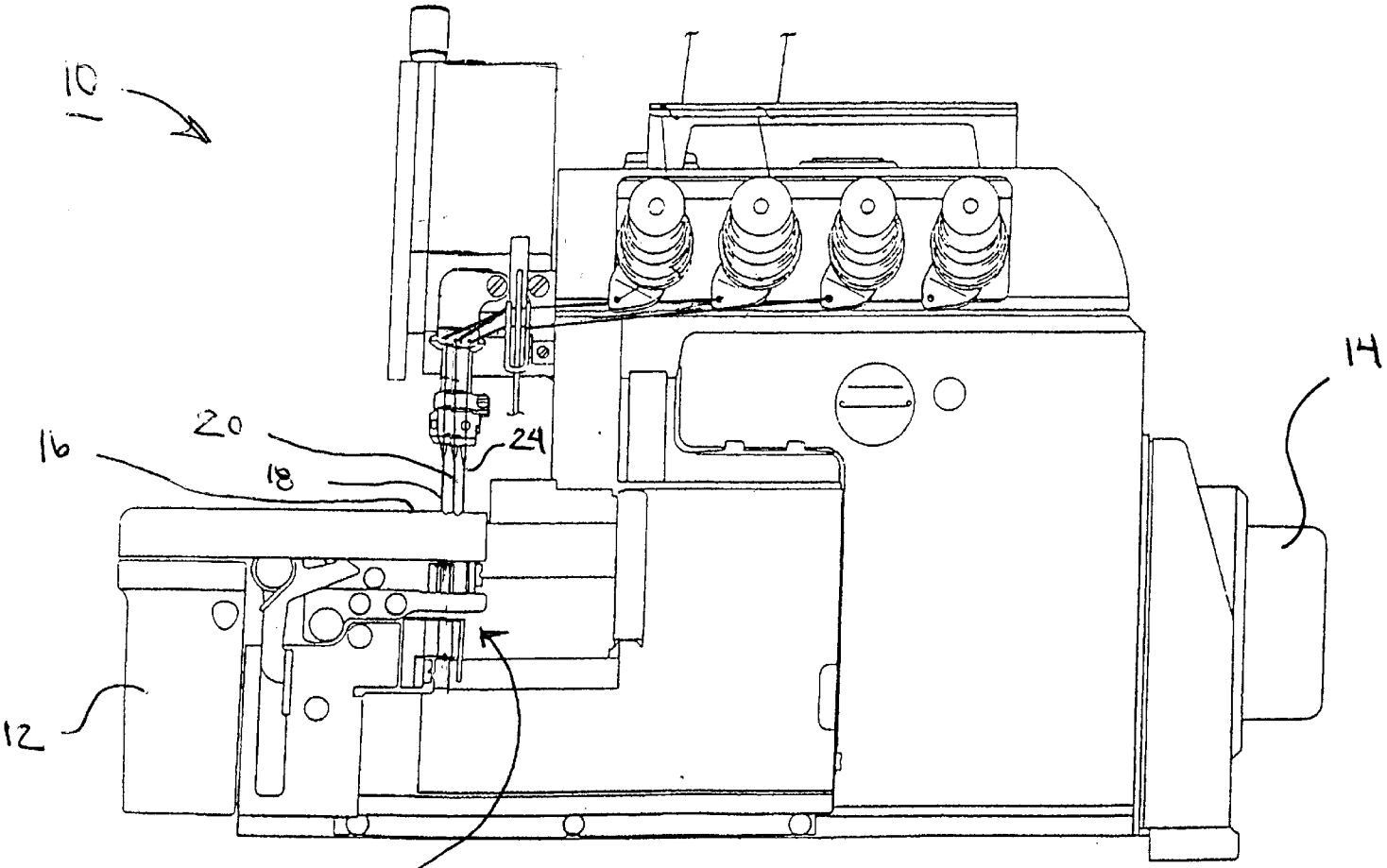
FIG. 2 is a front view of the tandem sewing machine of the present invention.

Referring now to the drawings in general and FIG. 2 in particular, it will be understood that the illustrations are for the purpose of describing a preferred embodiment of the invention and are not intended to limit the invention thereto. As best seen in FIG. 2, a tandem needle sewing machine, generally designated 10, is shown constructed according to the present invention. The sewing machine 10 includes three major sub-assemblies: a conventional sewing machine frame 12, an offset needle chuck 20 and a differential feed 30.

Tandem sewing machine 10 may be constructed using an existing sewing machine frame, such as shown in U.S. Pat. Nos. 5,816,175; 5,769,018; 5,398,627; 5,085,159; 4,834,010; 4,589,364; 4,570,558; and 4,407,210 which are hereby incorporated by reference in their entirety. Some such machines are known in the art by various names such as a flatbed-type machine, a feed-off-the-arm-type machine, a high speed overlock-type machine, an overedge machine, and a safety stitch machine.

In the preferred embodiment, tandem sewing machine 10 includes a stand frame 12 that supports a throatplate 16. The tandem sewing machine 10 is driven by a drive motor 14 a portion of which is depicted in FIG. 2. Anti-backlash teeth 26 sit coplanar with throatplate 16.

Figure 3:
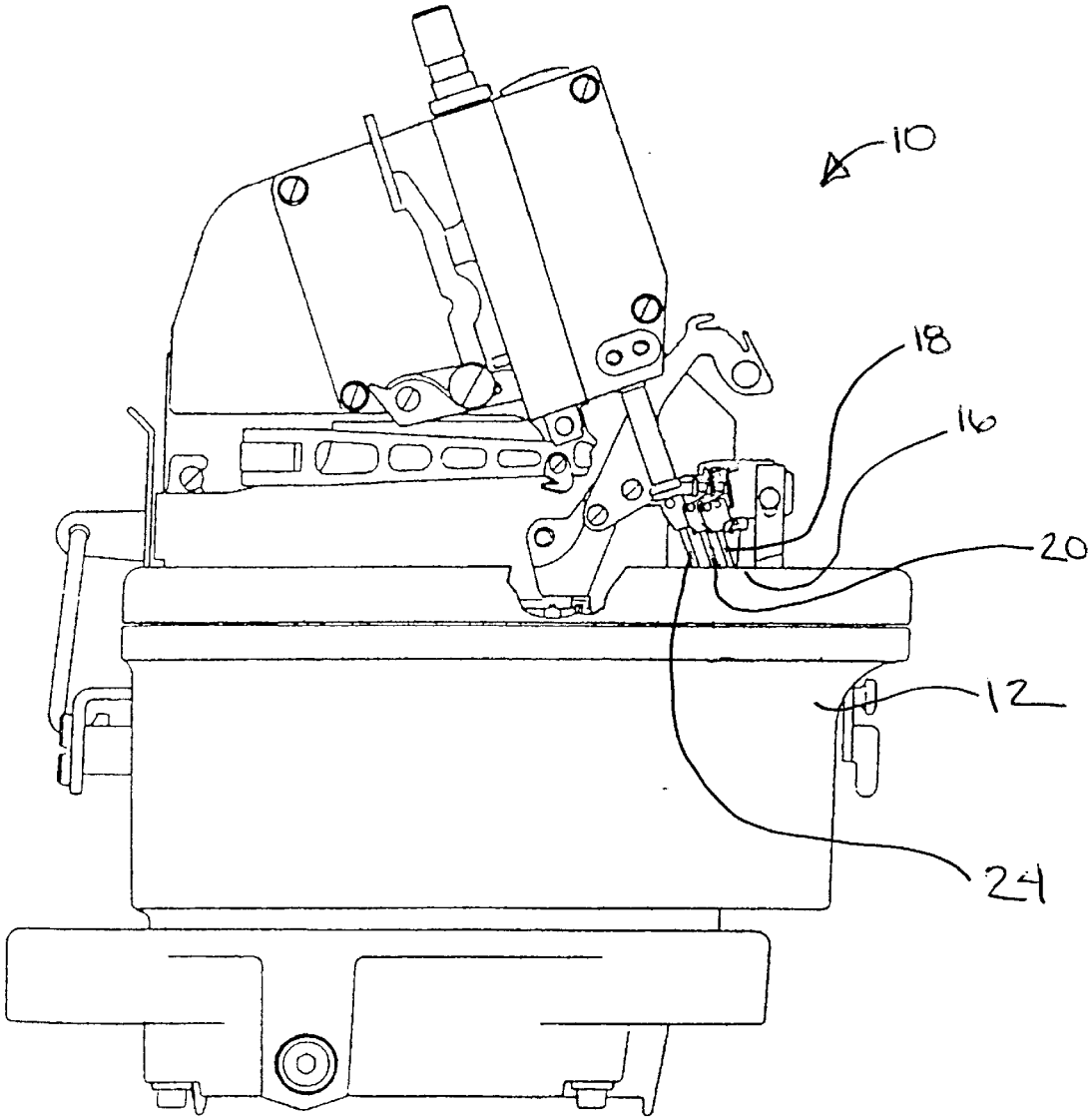
FIG. 3 is a side view of the tandem sewing machine.

According to the preferred embodiment of the present invention, at least two offset needles 18, 20 are driven by the sewing machine 10. As shown in FIG. 3, first needle 18 is offset from second needle 20. A third needle 24 provides for overstitching is part of an overedge stitching needle assembly 22 As best shown in FIG. 2, the tandem sewing machine 10 further includes a bottom stitching former 28. The sewing machine described in U.S. Pat. No. 5,085,159 may be modified for this purpose. This patent is hereby incorporated by reference in its entirety.

Figure 4:
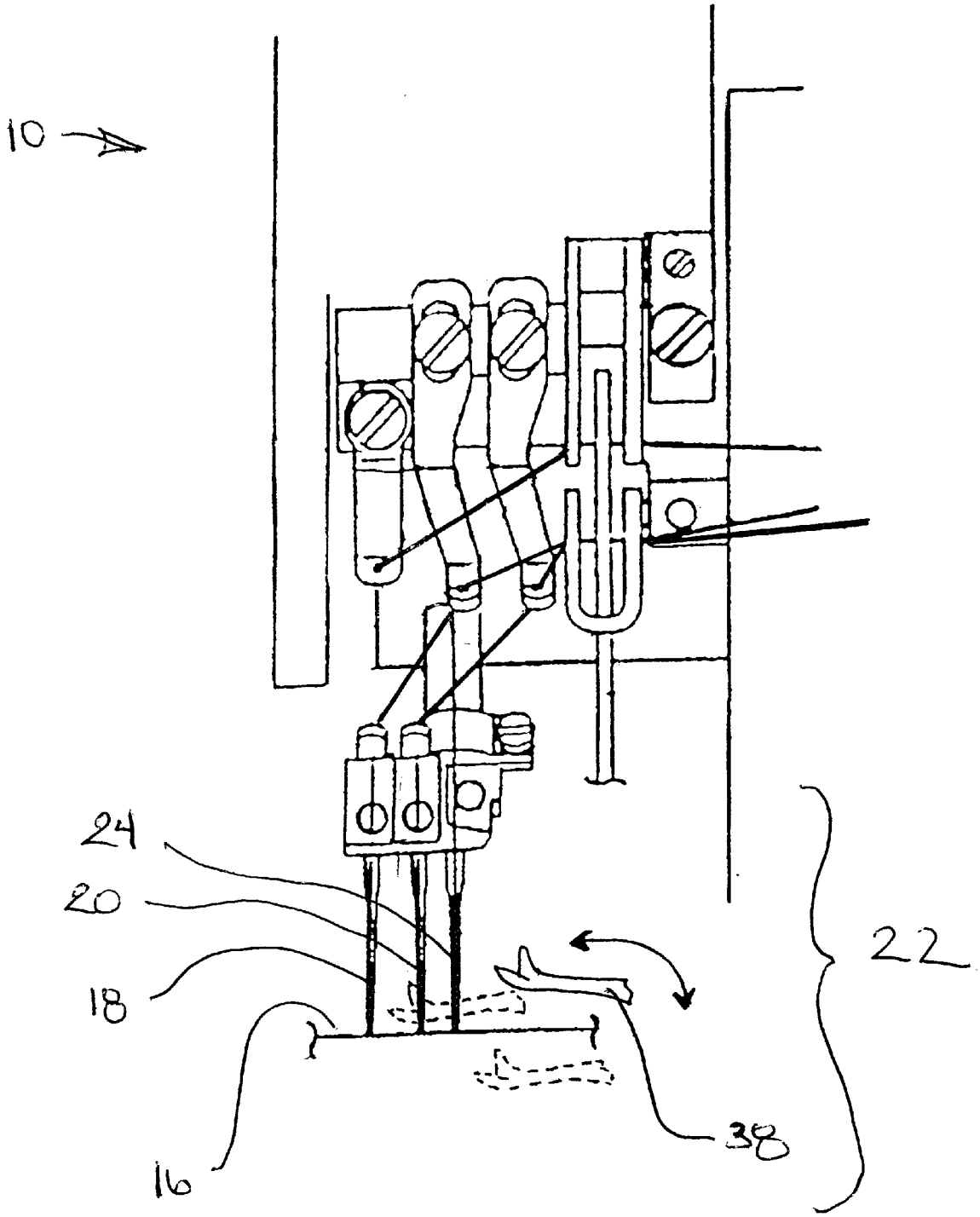
FIG. 4 is an enlarged front view of at least two offset needles and an overedge stitching needle assembly including an overstitching needle and an overstitching mechanism of the tandem sewing machine of the present invention.

With reference to FIG. 4, the tandem sewing machine 10 may further include an overedge stitching needle assembly 22 that includes a mechanism 38 for forming an overstitch. Mechanism 38 interacts with the needle for forming the overstitch 24 such that the thread is grabbed by the mechanism 38 to bring it over and under the fabric to create the desired stitching.

Figure 5:
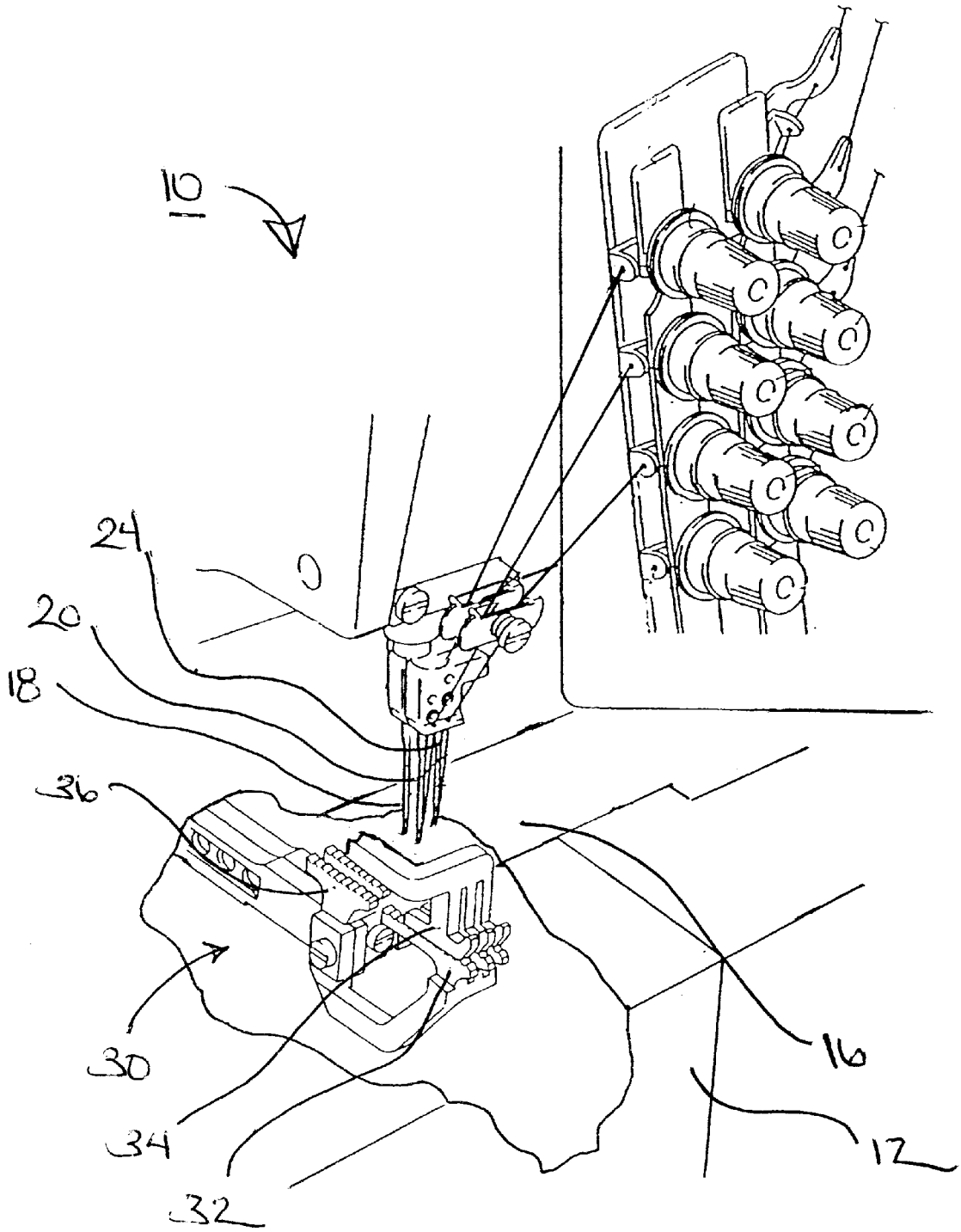
FIG. 5 is an enlarged perspective view of a compound feed assembly in combination with at least two offset needles and an overedge stitching needle of the tandem sewing machine of the present invention.

With reference to FIG. 5, the tandem sewing machine 10 may further include a compound feed assembly 30. This compound feed assembly 30 may include in the throatplate 16 or the proximity of the throatplate 16 a first bottom feed dog 32, a top feed dog 34 and even further, a second bottom feed dog 36. These feed dogs preferably work in concert in the case of bringing a single fabric through the sewing operation. Further, the feed dogs may be made to work independently. In such case, it may be desirable to have the feed dogs work independently because when sewing together fabrics having different qualities, it has been found that the fabrics may feed through the tandem sewing machine 10 at different rates.

To maintain a constant and consistent feed between a bottom fabric and a top fabric it is advantageous to have the bottom feed dog 32 feed at a rate appropriate for the bottom fabric while the top feed dog 34 would feed at a rate which is appropriate for the top fabric. The compound feed assembly 30 of the present application may include one such as that disclosed in U.S. Pat. No. 4,589,364, the disclosure of which is incorporated by reference in its entirety.

Figure 6:
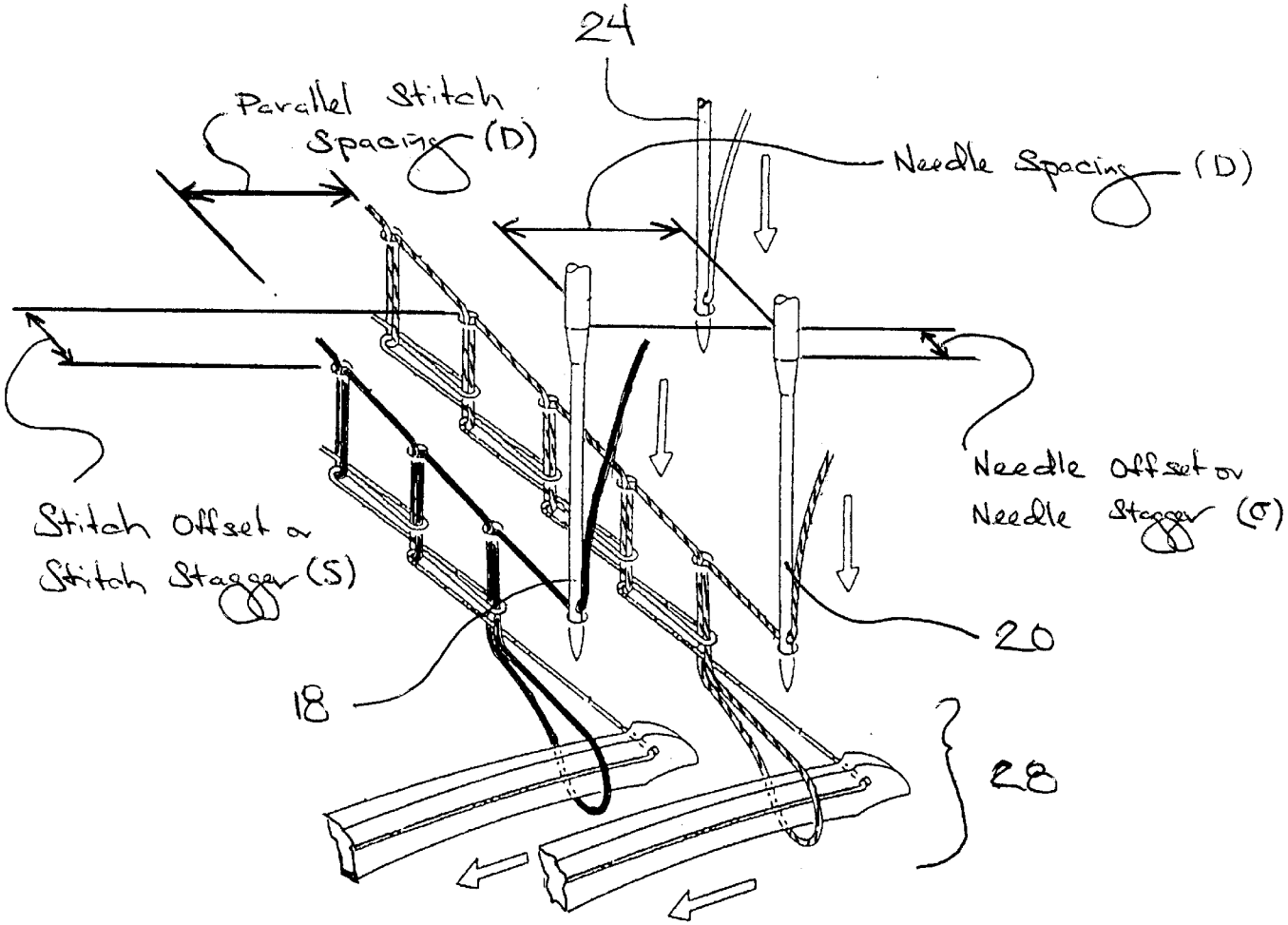
FIG. 6 is a diagram showing the formation of a parallel, offset chain stitche according to the present invention.

Referring now to FIG. 6, there is shown an enlarged schematic arrangement of the two offset needles 18, 20 and the further needle 24 for forming overstitching. First needle 18 creates a stitching indicated by a solid top thread and second offset needle 20 forms a parallel stitching indicated by a hatch top thread. The stitching according to this example is formed by two independent and identical bottom stitch formers 28. First needle 18 and second offset needle 20 are spatially related by (1) a needle spacing (D)and (2) a needle offset or stagger ($\sigma$). The resulting parallel stitching is characterized by a stitch offset or stitch stagger (S) and parallel or stitch spacing (D).

It should be understood that the needle offset or needle stagger ($\sigma$) is not necessarily the same as the stitch offset or stitch stagger (S). However, the needle spacing (D) is substantially equal to the parallel stitch spacing (D). The offset parallel stitching shown in FIG. 6 is unlike that disclosed in U.S. Pat. No. 5,398,627 issued Mar. 21, 1995 to Nishikawa, the disclosure of which is incorporated by reference in its entirety.

Figure 7A:
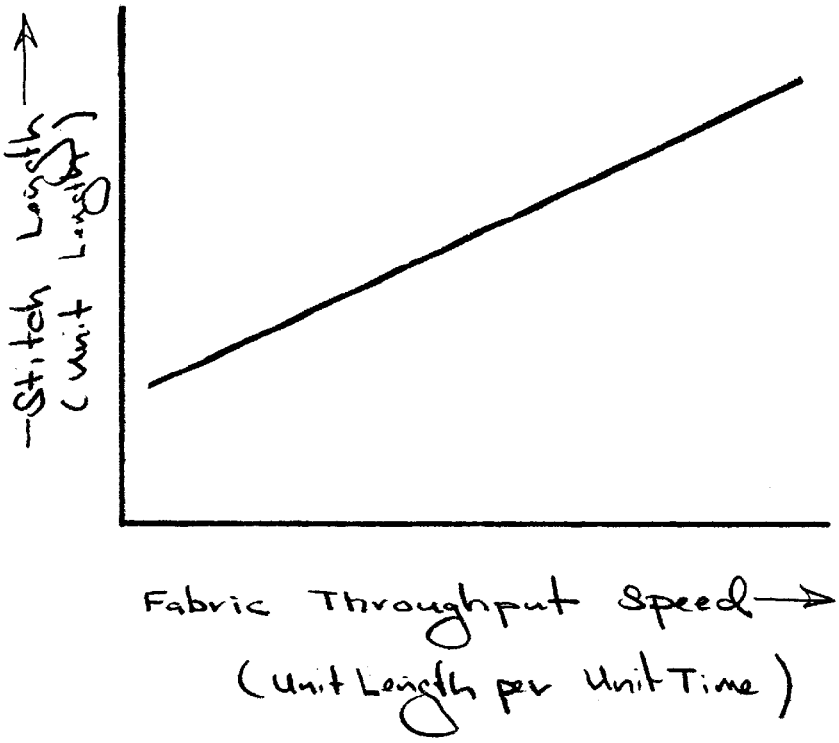
FIGS. 7A and 7B are graphs of stitch length as a function of a fabric throughput illustrating the increase in speed as a function of increasing stitch length and of stitch density as a function of fabric throughput speed illustrating the decrease in speed as a function of increasing stitch density.

FIG. 7A shows the fabric throughput speed in terms of a unit length per unit time and the resultant stitch length. As the fabric throughput speed increases, the stitch length will likewise increase.

Figure 7B:
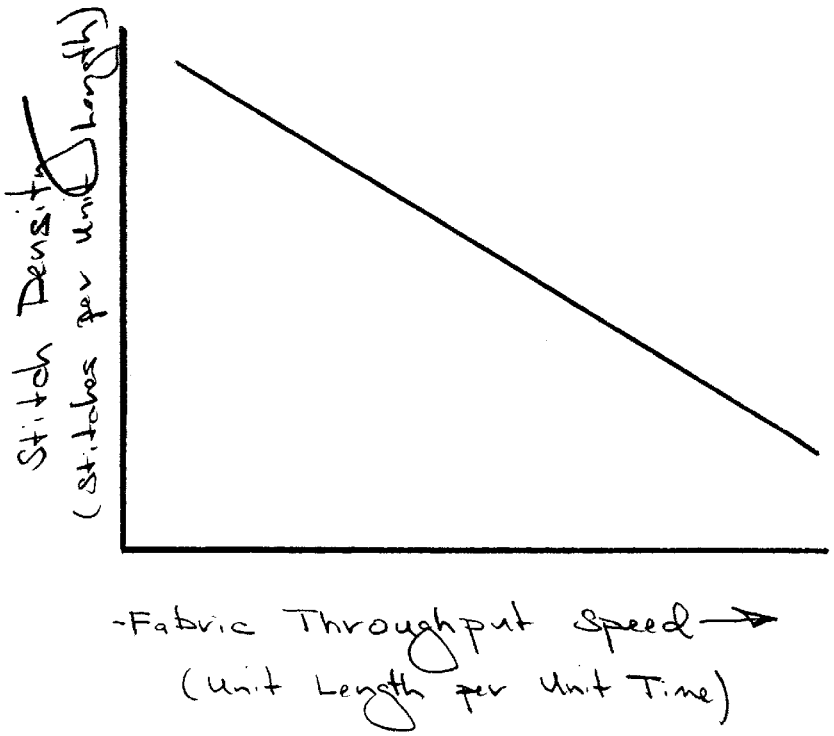

FIG. 7B shows the effect of fabric throughput speed on the stitch density. That is, the number of stitches per unit length as the fabric throughput increases, the density decreases.

Figure 8:
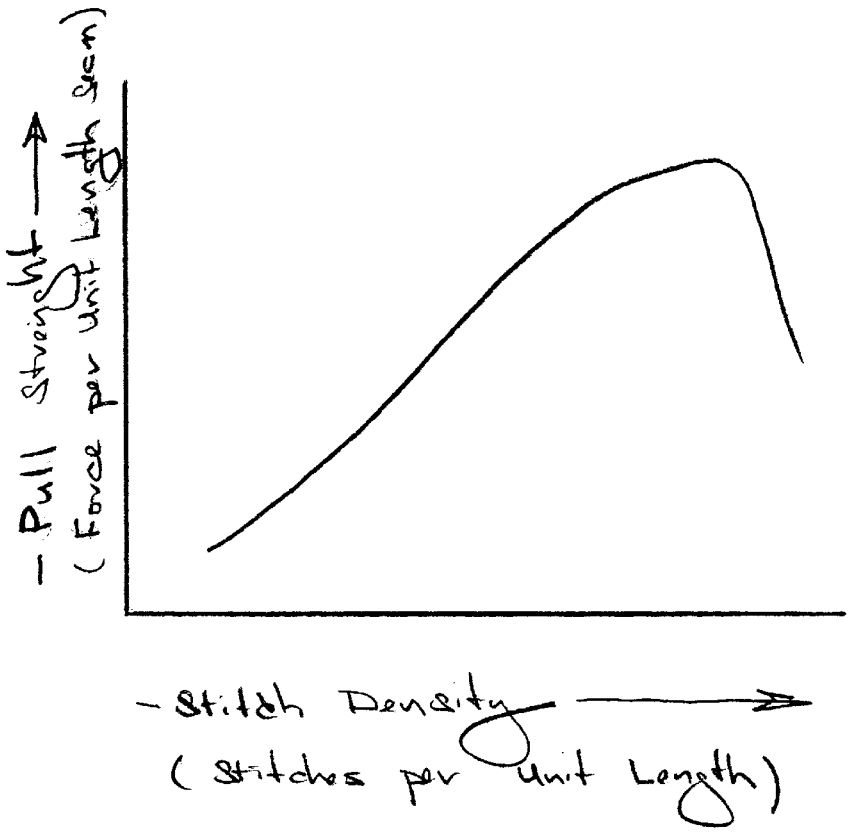
FIG. 8 is a graph of pull strength of the function of stitch density illustrating the increase in pull strength as a function of increasing stitch density until the stitches begin to destroy the integrity of the fabric.

FIG. 8 shows the pull strength that is the amount of load or force per unit length seam of a sewn seam as it is effected by the stitch density. As the stitch density increases, the pull strength would increase, there being more threads per unit length to carry the load; however, at some point the stitch density gets so great that there is damage to the fabric itself and the increase in additional threads holding the fabrics together is offset by the damage to the fabric. Therefore, the strength drops precipitously when the strength of the fabric has been compromised.

Figure 9:
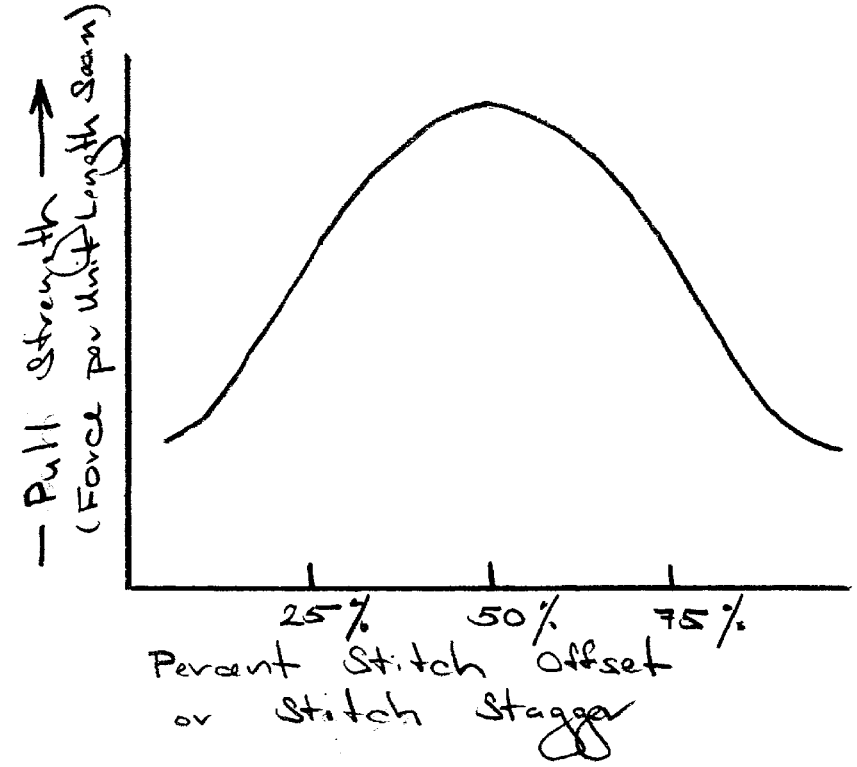
FIG. 9 is a graph of the pull strength as a function of percent stitch stagger (S) (stitch offset) illustrating the increase in pull strength as a function of increasing stitch stagger according to the present invention up to a maximum at 50% offset.

It may be beneficial for more filly understanding FIGS. 9, 10, 11 and 12 to refer back to FIG. 6 and consider the stitch offset or stitch stagger (S) and the parallel stitch spacing (D). For example, when considering the pull strength as a function of percent stitch offset or stitch stagger, the first thing to be understood is that stitch offset or stitch stagger becomes essentially the same at 0 and 100, as shown in FIG. 9.

This means that either there is an alignment when there is ho stagger or when there is 100% stagger. Accordingly, needle offset is not necessarily equivalent to the stitch offset in that the needle offsets can be set anywhere from 0 to 100 to create a different stitch offset. The maximum amount of strength of a stitch as the stitch staggers increase is seen when the stitch stagger or offset is at about 50%. Thus, it has been discovered that the stitch has its greatest strength when its neighbor is prevented from damaging the surrounding material. Other advantages of this stitching, in addition to pull strength, are seen in improved seam closure and seam grin.

Figure 10:
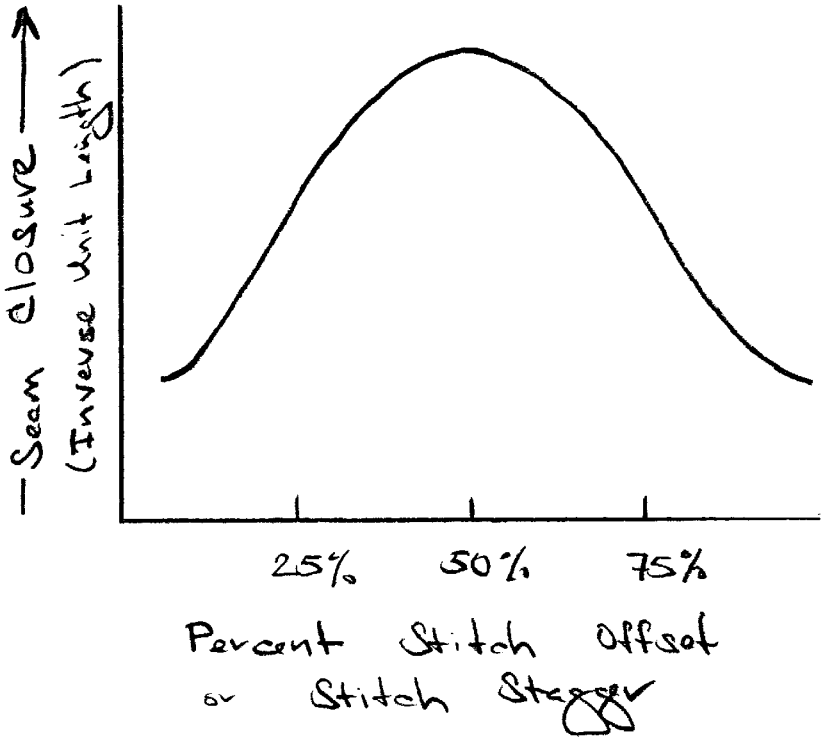
FIG. 10 is a graph of seam closure as a function of percent stitch stagger (S) illustrating the increase in seam closure as a function of increasing stitch stagger according to the present invention also up to a maximum at 50% offset.

FIG. 10 shows a graph plotting the percentage of stitch offset or stitch stagger and how that effects the seam closure. Once again, the maximum seam closure is seen when the stitch stagger is at about 50%. Inversely proportional to the seam closure is a term called grin. Grin relates to the length of threads that would be seen when a seam is pulled apart. Another way of characterizing grin is that it looks like someone with their mouth open and showing their teeth, the spacing between the teeth being equivalent to the threads that create the grin.

Figure 11:
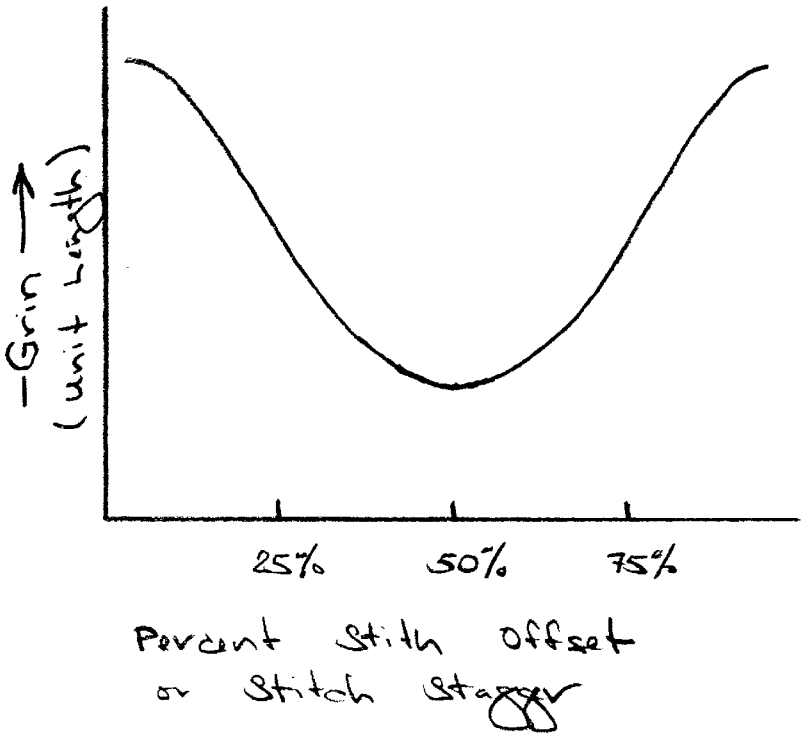
FIG. 11 is a graph of seam grin as a function of percent stitch stagger (S) illustrating the decrease in seam grin as a function of increasing stitch stagger according to the present invention also up to a maximum at 50% offset.

Being that grin is inversely proportional to the seam closure, it becomes apparent, as shown in FIG. 11, the grin is a minimum at the 50% offset and a maximum at 100%, where you get total alignment of the stitches, the stitch offset or the stitch stagger.

Figure 12:
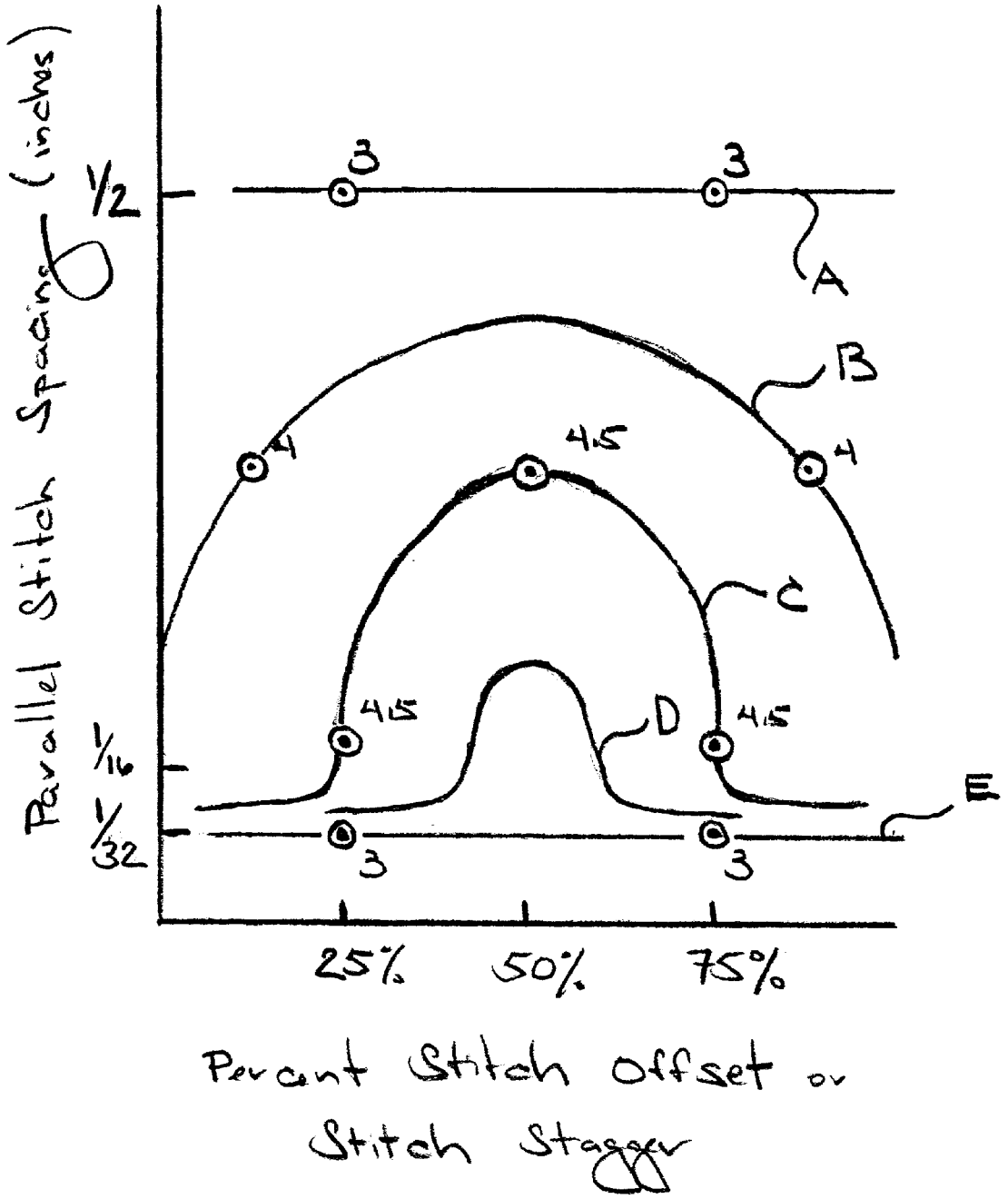
FIG. 12 is a topographic plot of the pull strength of a staggered stitch seam formed according to the present invention as a function of both parallel stitch spacing displacement (D) in inches with respect to one another and percent stitch stagger (S) illustrating the increase in pull strength as a function of increasing stitch stagger according to the present invention is limited to within a finite displacement range.

FIG. 12 shows in a topographic manner the strength of a stitch as both the function of the percentage stitch offset or stitch stagger and the parallel stitch spacing. Within FIG. 12 there are lines of constant strength in a normalized manner. Maximum strength in this case is at 5 and the minimum strength is at 1. The numbers denote the relative strength of a particular stitch set up as a function of both variables. Applicants believe that a parallel stitch spacing of about ½ inch, the parallel stitches are distanced far enough from each other that there is no constructive or synergistic effect between the parallel stitches. Effectively, at a distance of ½ inch or greater, the stitches have no reinforcing effect to each other. However, once you get lower than about ½ inch, the parallel stitches start giving each other reinforcing effects.

As can be seen in FIG. 12, on a scale of 1–5, line A has a value of about 3, curve B has a value of 4, curve C has a value of 4.5 and curve D has a value of 5. However, curve E shows that if the displacement is less than about 1/32, the stitches begin to interfere with one another similar to the effect shown in FIG. 8 for a single chain stitch. Thus, it appears that the stitch strength at a given percentage stitch offset or stitch stagger increases as the parallel spacing is decreased and that once again the best strength is attained at about 50% stitch stagger.

Figures 13A, 13B, 13C, 13D, 13E:
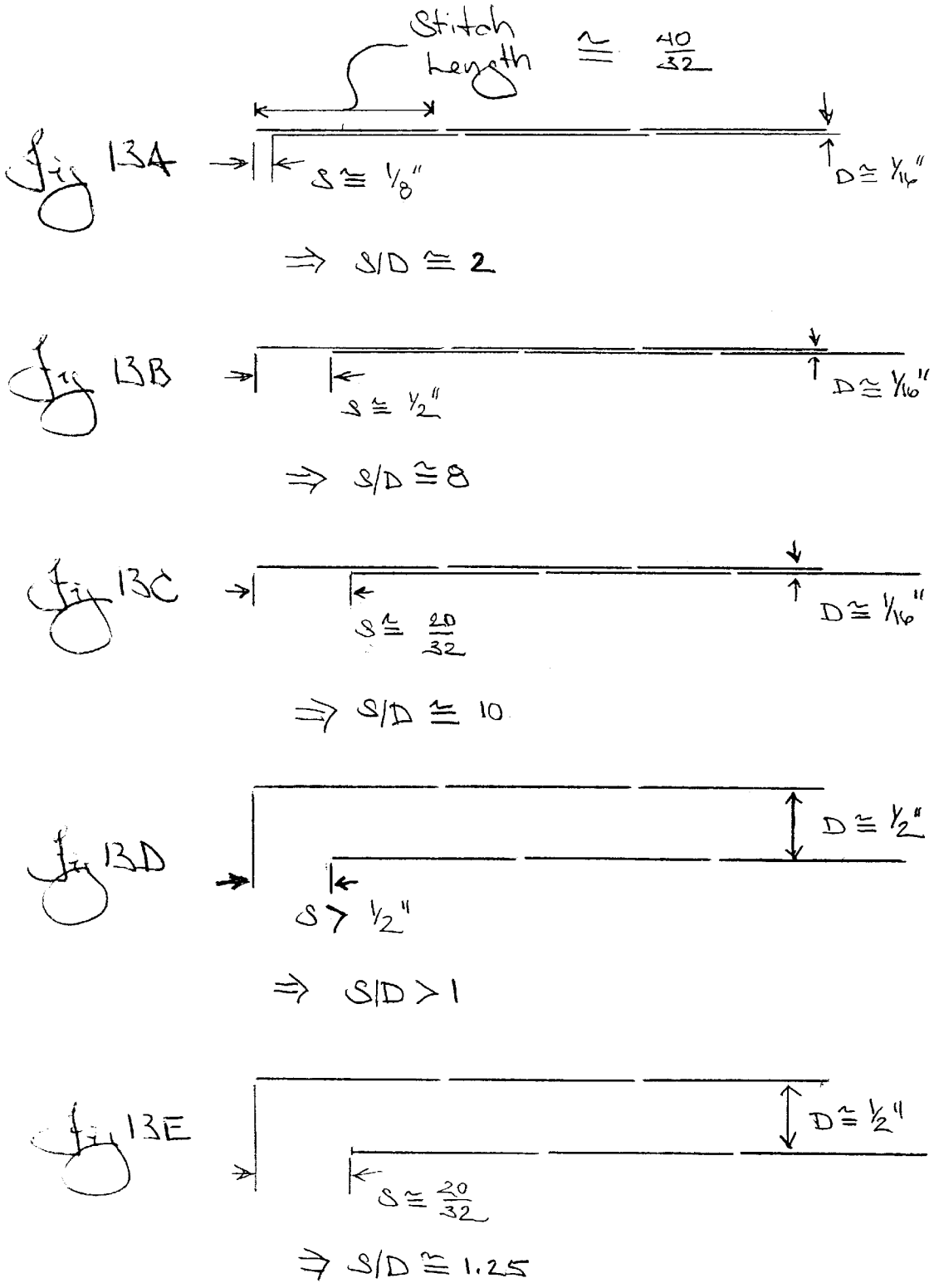
FIGS. 13A through 13G are schematics of variations of the parallel, offset chain stitch constructed according to the present invention.
Figure 13F:
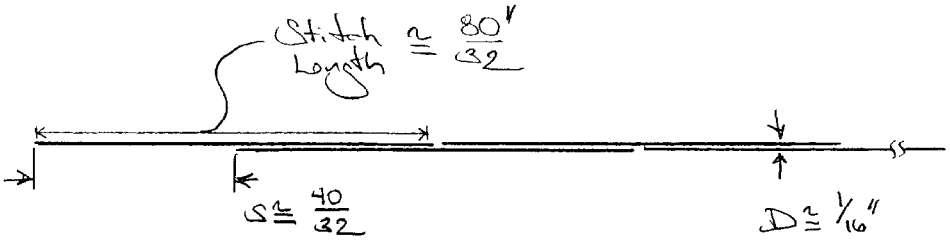
Figure 13G:
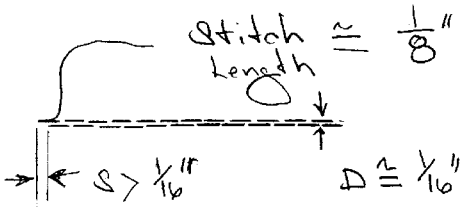

It has been discovered that where the S/D ratio is greater than or equal to about 1, there is a substantial increase in pull strength which allows the stitch length to be greatly lengthened, thereby substantially increasing speed and productivity. In the preferred embodiment, the S/D ratio is greater than or equal to about 1.3 and, preferably, about 20. FIGS. 13A through 13G are schematics of some parallel, offset chain stitches constructed according to the present invention. In FIGS. 13A through 13C the stitch length of each chain is about 40/32 inches, the stitch spacing (D) is about 1/16 inch. The stitch offset or stitch stagger (S) is about 1/8 inch, 1/2 inch and about 20/32 inch, respectively, thereby having a S/D ratio of about 2, about 8, and about 10, respectively. In FIGS. 13D and 13E the stitch length of each chain is about 40/32 inches, the stitch spacing (D) is about 1/2 inch. The stitch offset or stitch stagger (S) is about 1/2 inch and about 20/32 inch, respectively, thereby having a S/D ratio of greater than about 1, and about 1.25, respectively. In FIG. 13F the stitch length of each chain is about 40/32 inches, the stitch spacing (D) is about 1/16 inch, the stitch offset or stitch stagger (S) is about 40/32 inches thereby having a S/D ratio of about 20. In FIG. 13G the stitch length of each chain is about 1/8 inch, the stitch spacing (D) is about 1/16 inch, the stitch offset or stitch stagger (S) is greater than about 1/16 inch thereby having a S/D ratio greater than of about 1.

Certain modifications and improvements will occur to those skilled in the art upon a reading of the foregoing description. By way of example, the stitch density for shirt construction may be increased over that of pant seams for added strength. Also, while mechanical control of the needles has been used in the present invention, the synchronization of the needles and loopers could also be controlled with electronic logic instead of gear ratios and shafts. It should be understood that all such modifications and improvements have been deleted herein for the sake of conciseness and readability but are properly within the scope of the following claims.

We claim:

1. A tandem sewing machine, said sewing machine comprising:

(a) a stand frame, (b) a drive motor;

(c) a throatplate;

(d) at least two offset needles wherein the stitch formed by said offset needles has a stagger to displacement ratio (S/D) of greater than 1; and (e) a compound feed assembly, wherein said compound feed assembly includes a bottom feed dog and a top feed dog.

2. The sewing machine according to claim 1, wherein said top feed dog is a differential feed with respect to said bottom feed dog.

3. The sewing machine according to claim 1, further including a second bottom feed dog.

4. The sewing machine according to claim 3, wherein said bottom feed dog is a differential feed.

5. A tandem sewing machine, said sewing machine comprising:

(a) a stand frame;

(b) a drive motor;

(c) a throatplate;

(d) at least two offset needles wherein the stitch formed by said offset needles has a stagger to displacement ratio (S/D) of greater than about 1; and (e) an overedge stitching needle assembly.

6. The sewing machine according to claim 5, wherein said overedge stitching needle assembly includes at least one needle performing an overedge stitch.

7. The sewing machine according to claim 5, wherein said S/D ratio is greater than or equal to about 1.3.

8. The sewing machine according to claim 7, wherein said S/D ratio is about 20.

9. The sewing machine according to claim 5, further including means of forming a bottom stitch.

10. The sewing machine according to claim 9, wherein said means for forming a bottom stitch is a looper assembly.

11. The sewing machine according to claim 10, wherein said looper assembly is a cross breakaway looper.

12. The sewing machine according to claim 5, wherein said throatplate further includes anti-backlash teeth.

13. A tandem sewing machine, said sewing machine comprising:

(a) a stand frame;

(b) a drive motor;

(c) a throatplate; and (d) at least two offset needles wherein the stitch formed by said offset needles has a stagger to displacement ratio (S/D) of greater than about 1;

(e) an overedge stitching needle assembly; and (f) a compound feed assembly.

14. The sewing machine according to claim 13, wherein said compound feed assembly includes a bottom feed dog and a top feed dog.

15. The sewing machine according to claim 14, wherein said top feed dog is a differential feed with respect to said bottom feed dog.

16. The sewing machine according to claim 14, further including a second bottom feed dog.

17. The sewing machine according to claim 16 wherein said bottom feed dog is a differential feed.

18. The sewing machine according to claim 13 wherein said overedge stitching needle assembly includes at least one needle performing an overedge stitch.

19. The sewing machine according to claim 13, wherein said S/D ratio is greater than or equal to about 1.3.

20. The sewing machine according to claim 19, wherein said S/D ratio is about 20.

21. The sewing machine according to claim 13, further including means of forming a bottom stitch.

22. The sewing machine according to claim 21, wherein said means for forming a bottom stitch is a looper assembly.

23. The sewing machine according to claim 22, wherein said looper assembly is a cross breakaway looper.

24. The sewing machine according to claim 13, wherein said throatplate further includes anti backlash teeth.

* * * * *

UNITED STATES PATENT AND TRADEMARK OFFICE

CERTIFICATE OF CORRECTION

PATENT NO. : 6,467,418 B1
DATED : October 22, 2002
INVENTOR(S) : Renia et al.

It is certified that error appears in the above-identified patent and that said Letters Patent is hereby corrected as shown below:

Title page,
Insert item -- [73] Assignee: V.F. Workwear, Inc. --

Signed and Sealed this

Twenty-sixth Day of August, 2003

JAMES E. ROGAN
*Director of the United States Patent and Trademark Office*